US005694851A

United States Patent [19]

Bruni

[11] Patent Number: 5,694,851

[45] Date of Patent: Dec. 9, 1997

[54] CONTROL DEVICE FOR THE SUPPLY OF INK TO AN OFFSET PRINTING MACHINE

[75] Inventor: Hanspeter Bruni, Welsikon-Dinhard, Switzerland

[73] Assignee: Sycolor Consulting AG, Switzerland

[21] Appl. No.: 790,307

[22] Filed: Jan. 28, 1997

Related U.S. Application Data

[63] Continuation of Ser. No. 711,958, Sep. 6, 1996, abandoned, which is a continuation of Ser. No. 385,097, Feb. 7, 1995, abandoned.

[30] Foreign Application Priority Data

Feb. 15, 1994 [CH] Switzerland ..... 00443/94

[51] Int. Cl.[6] ..... B41F 31/04; B41L 27/06

[52] U.S. Cl. ..... 101/365

[58] Field of Search ..... 101/365, 157, 101/169, 363, 350; 118/261; 15/256.51; 74/10.29–10.37, 567, 569

[56] References Cited

U.S. PATENT DOCUMENTS 4,051,782 10/1977 Fernandez ..... 101/365

FOREIGN PATENT DOCUMENTS 2550720 6/1977 Germany .

58-173662 1/1984 Japan .

2056373 3/1981 United Kingdom .

WO9419194 9/1994 WIPO .

*Primary Examiner*—J. Reed Fisher

*Attorney, Agent, or Firm*—Bachman & LaPointe, P.C.

[57] ABSTRACT

The offset printing machine comprises at least one flexible ink blade (14) which, angled in the direction of an ink roller (12), borders an ink bath (40) and can be bent in zones to different degrees against the cylindrical surface of the ink roller (12), and adjustment means for bending the ink blade edge (36). The adjustment means has tappets (92) axially displaceable in a guide and an adjustment cam (62) allocated to each, with the cam axis (L) parallel to the ink roller axis (A). The tappets (92), preferably individually adjustable length-wise, are pressed by springs (100) against the peripheral surface (72) of the adjustment cam (62). The self-locking positionable adjustment cams (62) are arranged alternately in the modular principle with bearing jaws (64) for their non-rotatable coaxial bearing bolts (60) on a mounting rail (56), for interchargeable mounting as a control unit (58) directly or via an adapter on an offset printing machine. The peripheral surface (72) of the adjustment cam (62), produced with very high precision, lies freely in a longitudinal groove (89) of the control unit (58), and is progressively curved according to a further feature of the invention.

12 Claims, 5 Drawing Sheets

CONTROL DEVICE FOR THE SUPPLY OF INK TO AN OFFSET PRINTING MACHINE

This is a continuation of applications(s) Ser. No. 08/711,958 filed on Sep. 6, 1996, now abandoned which is a continuation of Ser. No. 08/385,097 filed Feb. 7, 1995, now abandoned.

BACKGROUND OF THE INVENTION

The invention relates to a control device for the supply of ink to an offset printing machine with at least ink blade which, angled in the direction of an ink roller, borders an ink bath and can be bent in zones to different degrees against the cylindrical surface of the ink roller, and adjustment means for bending the ink blade edge, where these means have tappets axially displaceable in a guide and one adjustment cam allocated to each, with the cam axis parallel to the ink roller axis, where the tappets are pressed by springs against the peripheral surface of the adjustment cam.

DE,A1 2550720 describes a generic ink supply control unit where the adjustment means in the ink system have tappets which can be displaced in the direction of their longitudinal axis by a cam. Each tappet is mounted on bearings in a carrier device to swivel about its axis vertical to the ink roller axis. Each tappet is also fitted with a spring which constantly presses it against the allocated cam. A cam can be turned by an adjustment lever activated manually from the outside such that the lower edge or the flexible ink blade can be adjusted via the tappets in zones against the shell of the ink roller. The adjustment levers are swivelled within a scale so that a specific setting can be reproduced. The zoned adjustment of the ink blade is considerably improved if this is designed as a sectioned ink blade.

Sectioned ink blades are known for example from CH,A5 602345 and referred to as ink blades for the ink duct roller. In the area of the working edge, this ink blade has recesses both sides of adjacent adjustment screws. The sections thus formed can be adjusted individually, any influence on the adjacent blade area is excluded or at least considerably reduced. The thickness of the ink layer can be set via tho adjustment screws on each section, individual ink supplies in the various ink zones can be controlled as the printing image in the various width ranges require. The intermediate spaces between the sections must be designed such that no ring beads can occur on the ink roller.

The known control devices for zoned adjustment of ink blades using tappets have the disadvantage that they are relatively complex. To support the adjustment cam, they each require mechanisms consisting or a multiplicity of individual parts. The adjustment system for the known tappets is also complicated.

SUMMARY OF THE INVENTION

The inventor has approached the task of creating a control device of the type initially described, which is universally applicable, has easily adjustable tappets and play-free supportable adjustment cams with precise reproducible settings.

The task is solved according to the invention in that the self-locking positionable adjustment cams are arranged alternately with bearing jaws for their non-rotatable coaxial bearing bolts on a mounting rail, for mounting directly or via an adaptor for interchangeable fixing on the offset printing machine, the peripheral surface of the adjustment cam lying freely in a longitudinal groove of the control unit. Special and further developed design forms of the control device are the subject of the dependent patent claims.

The mounting rail or adaptor is designed in a known manner such that the device according to the invention can be attached to any offset printing machine as a control unit. The adapter may for example be a simple angle bracket.

The longitudinal groove of the control unit with free adjustment cams is designed preferably rectangular in cross-section and is used to guide sliding blocks which each carry the free end of a respective tappet. The sliding blocks appropriately lie directly on the peripheral surface of the adjustment came and transfer the force generated by this to the tappet which in turn lies directly on the flexible ink blade. The sliding blocks have only a certain degree of sideways play which can be eliminated by spacers, guides or similar known means.

The tappets are mounted longitudinally, preferably in the central longitudinal plane, in a hole in the respective sliding block, where the hole preferably has an internal thread, and the tappet an external thread. The tappets, preferably individually adjustable length-wise, are fitted with means which allow easy application of turning force from the outside. Although the thread of the sliding block and tappet is self-locking, fixing the tappet contributes to the operating safety.

Of essential importance to the invention is the design of the peripheral surface of the adjustment cam, in other words the surface on which the bolt or sliding block carrying the bolt sits directly. In all known design forms for the production of cams for ink ducts, two circular shell surfaces ere moved against each other. Peripheral surfaces preferred according to the invention have the greatest distance from the rotating axis to which they run parallel in the direction of extension of the adjustment lever. On at least one side, the peripheral surface is designed such that the distance diminishes progressively to a certain angle. When the adjustment cam is turned, this diminishing distance causes a targeted displacement of the tappet and thus opens the gap between the ink blade and the ink roller through which more ink can flow. This means that for example:

- with a movement of the adjustment lever on the scale from position 0 to 15, the tappet is moved by 0.05 mm,
- with a further movement of the adjustment lever from position 15 to 25 on the scale, the tappet is moved by a further 0.10 mm, and
- with a further movement of the adjustment lover from position 25 to 35 on the scale, the tappet is moved by a further 0.15 mm.

The progressively curved peripheral surface of the adjustment cam must be machined with very great precision. The setting of the ink gap is more sensitive the closer the ink blade edge is pressed to the ink roller. The peripheral surface of the adjustment cam and the position of its hole to hold the bearing bolts are calculated according to progression using known specified parameters for the mathematical methods.

The adjustment cams mounted to rotate on at least one fixed bearing bolt preferably have a broke element for achieving self-locking which is pressed onto the bearing bolt(s). The operating safety and reliability of the relative angle of the adjustment cam to the bearing bolts is of essential significance, and adjustment is normally carried out daily for each print order.

For the basic setting or calibration, all adjustment cams are brought into the contact position with the ink blade lying against the roller in all zones, where the manual adjustment levers lie in the zero position or electronically adjustable cams show a zero position. An optimum setting of the adjustment cam for a specific work process can be read by the printer, recorded and reproduced for an identical subsequent order. With electronic activation of the adjustment cams, the setting is recorded, saved and restored automatically by means of a processor.

In a first variant, to set the self-locking of the adjustment cam, the adjustment lever is screwed into a hole extending to the guide bolt. A force is then exerted directly or via an intermediate part, e.g. a spring, on a brake element lying on the guide bolt. This for example takes the form of a washer or the surface of the guide bolt is adapted on one side. The brake element consists for example of aluminium or a plastic. No scratch marks may be left on the guide bolt and/or it must not seize.

In a further preferred variant, the hole for the brake element of an adjustment cam does not lie on the extension of its adjustment lever but is angled to this. The brake element is again pressed on the guide bolt by a force exerted by a screw either directly or via spring.

The production of the adjustment cam, in particular its progressively curved peripheral surface, requires very great precision and is therefore relatively expensive. In a particularly advantageous further development of invention, the adjustment cams are therefore produced in a uniform standard width and with standardized curve characteristics for their peripheral surfaces. Depending on make, the sections of an ink blade are designed in different widths. The distances from section centre to section centre vary for example between 28 to 35 mm. Thus a control unit according to the invention with standardized adjustment cams can be mounted on all makes, and the width of the adjustment cam is produced according to the smallest distance from section centre to section centre, less the width of a bearing jaw. Wider distances can be compensated by the bearing jaws being produced correspondingly wider. So that the bearing jaws can also be held uniformly on the bearing, at larger widths correspondingly wide washers are preferably fitted on both sides of the adjustment cam. The standardized adjustment cams preferably nave a stepped constriction of the peripheral surface on both ends. The peripheral surface, reduced in width, corresponds to a groove in the relevant sliding block which also creates a perfect guide in the axial direction of the bearing bolts.

The control unit according to the invention is constructed on the modular principle, and is particularly suitable for retrofitting to all makes of offset printing machine. Depending on the comfort level required, it can act on simple ink blades where are usually found on basic equipment or on a zoned ink blade. The cams can be adjusted manually or, in the highest comfort level, automatically in a known manner by electronically controlled adjustment elements.

Suitable control units with the same standard adjustment cam can be mounted on each make via a mounting rail or a simple adapter preferably in the form of an angled profile.

Standardized adjustment cams, in particular with high precision progressively curved peripheral surfaces, are of essential significance as the costs of production and mounting can be reduced decisively.

Progressively curved peripheral surfaces on an adjustment cam allow the precision of the setting to be specified as required. With a narrow gap between the ink blade edge and the ink roller, a far greater degree of adjustment precision is required than with a broad ink flow gap.

Finally, the necessary self-locking of the adjustment cam and the length adjustment of the bolts to transfer the force from the adjustment cam to the ink blade is solved in a more simple, safe manner.

BRIEF DESCRIPTION OF THE DRAWING

The invention is described in more detail using the design examples shown in the drawing which are the subject dependent patent claims. The diagrams show:

DETAILED DESCRIPTION

Figure 1:
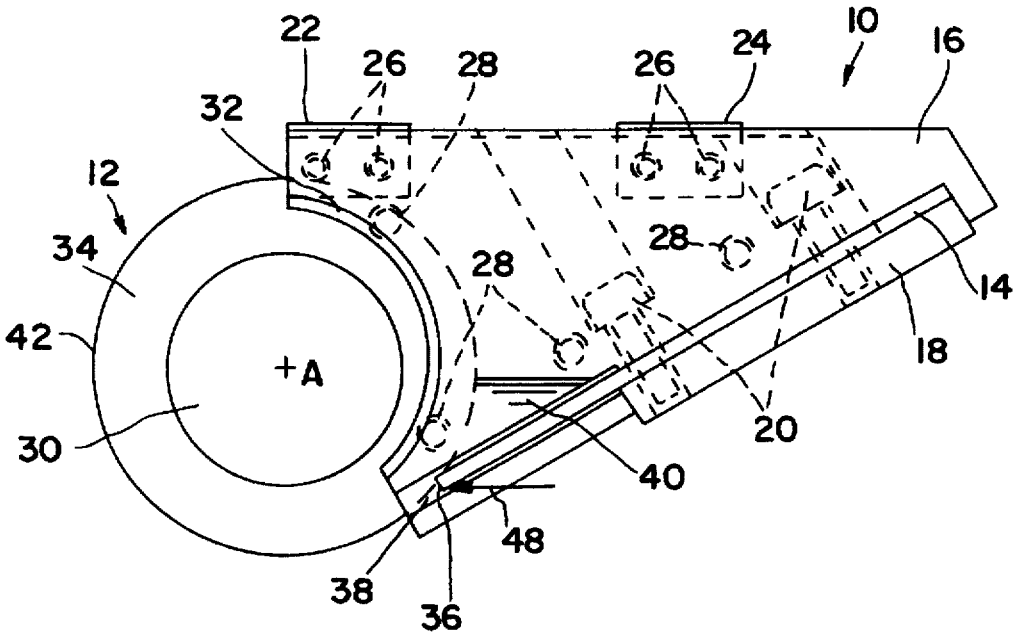
FIG. 1: a partial cross-section side view of a known in duct with ink roller in the working position.

An ink duct 10, known in itself and shown in FIG. 1 with an ink roller 12, comprises an ink blade 14 made of a flexible metal plate and side jaws 16 arranged on both sides. In the example shown, these side jaws 16 consist of a metal jaw connected to a blade carrier 18 by countersunk screws 20 and a plastic plate held under spring tension on the metal jaw via hook clamps 22 and retaining clamps 24. The clamps 22, 24 are connected to the metal jaw by screws 26. In the present case, four sprung round-head screws 28 press the plastic plate against the front of ink roller 12 with a total force of around 10N.

The side jaw 16 has clearance in the area of the roller journal 30 of the ink roller 12, which ink roller has longitudinal axis A. Of the plastic plate of the side jaw 16, only a part segment 32 is visible, which lies on the front 34 of the ink roller 12 and ensures a side seal. Wear on the part segment 32 is balanced as the sprung round-head screws 28 press against the plastic plate.

In the area of the ink blade edge 36, the plastic plate of the side jaw 16 has a groove with mastic 38 on which lies the ink blade 14.

In the lowest area of the ink duct 10 is an ink bath 40 which is sealed clean.

Figure 2:
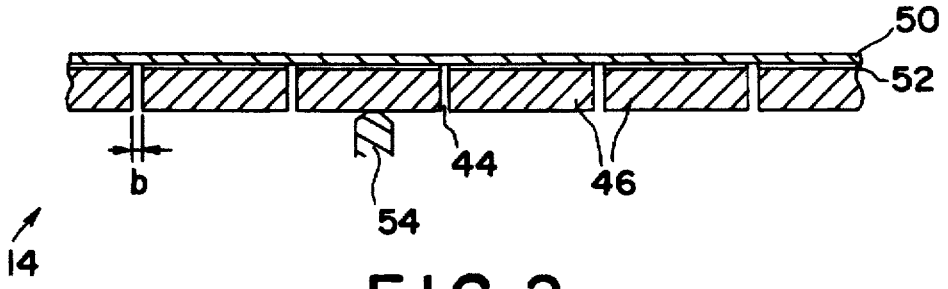
FIG. 2: a partial longitudinal section through a sectioned ink blade.

In the area of the blade edge 36 which rests on the running surface 42 of the ink roller 12 or which is pressed against this in its vicinity, the ink blade 14 is suitably divided into sections 46 by equal length cuts 44 running at right angles to the edge (FIG. 2). The individual, preferably equal width, sections 46 can, as shown by arrow 48, be bent elastically parallel to the roller axis A by the action of adjustment means. Known adjustment means are for example simple adjustment screws, cams or further developed and even automatic adjustment means.

As already stated, FIG. 2 shows part of a sectioned ink blade 14. The gaps b between the sections 46 are also sealed so that no ink can actually escape. This can be done in the known manner. In the present case, a thin flexible metal strip 50 is applied, and sealed, preferably by means of an adhesive 52, to the top of the sections 46 which are usually 1–3 mm thick, in particular 1.5–2.5 mm thick. Each section 46 is pressed against the running surface 42 of the ink roller 12 (FIG. 1) by means of adjustment means indicated on one section, in the present case a bolt 54, so that the flow of ink can he reduced in zones or even prevented if the section 46 concerned is bent accordingly. The flexible, for example approx. 0.2 mm thick, strip 50 made of sprung steel can compensate for this shift without essentially affecting the adjacent sections 46 and prevents absolutely any escape of ink between the sections 46.

Figure 3:
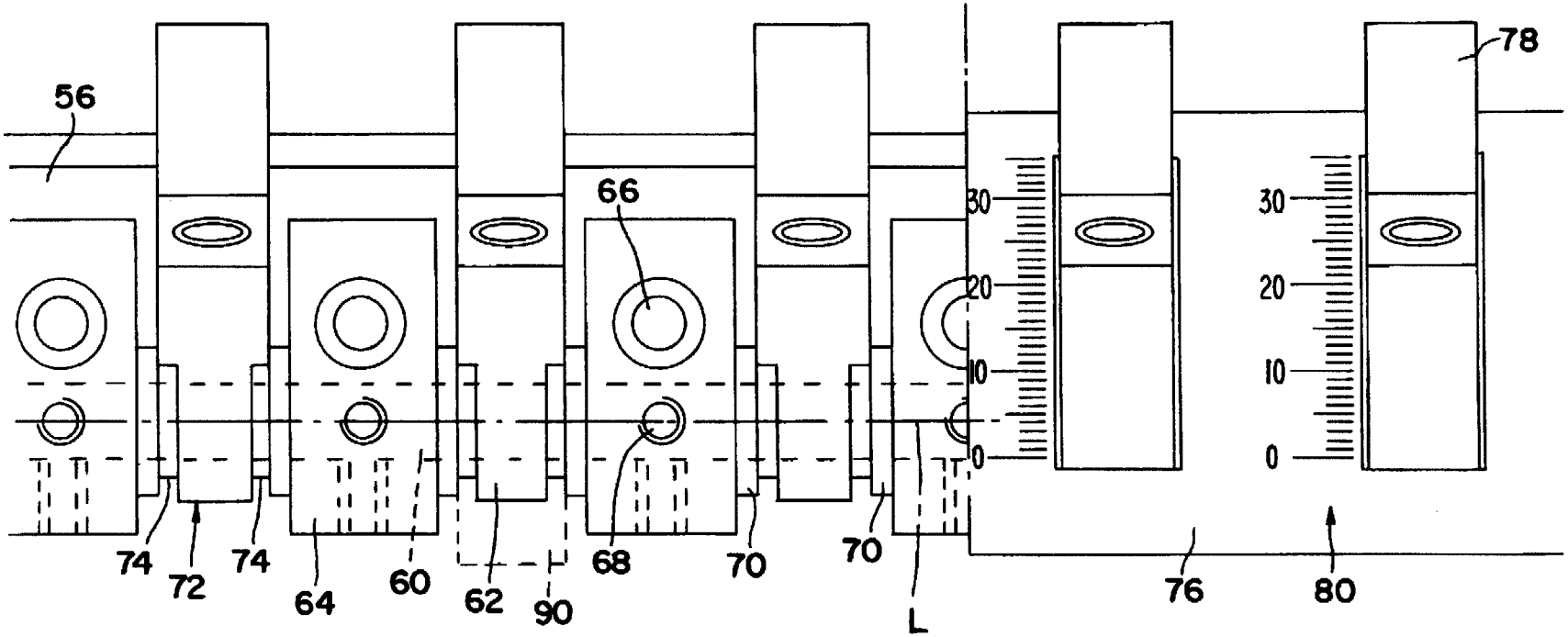
FIG. 3: a view of a partially covered control unit.

The control unit 58 shown in FIG. 3, which can be mounted directly on any offset printing machine via an adapter or by means of a mounting rail 56 angled upwards, comprises, essentially alternately, adjustment cams 62 swivelling on at least one bearing bolt 60, and bearing jaws 64.

The bearing bolt(s) 60 are arranged coaxially on a longitudinal axis L running parallel to the roller axis A. The bearing bolts 60 are formed separately for each adjustment cam 62. Evidently a bearing bolt 60 can also extend over several bearing jaws 64 or over the entire length of the control unit 58.

The bearing jaws 64 are individually screwed to the mounting rail 56, FIG. 3 shows one countersunk screw 66 for, each. Each bearing jaw has a threaded hole 68 for a screw for fixing bearing bolt 60.

In the present case, the bearing jaws 64 are arranged at intervals of 32 mm measured from centre to centre. The width of the standard adjustment cam 62 is 28 mm. To fix the adjustment cam 62 in the direction of longitudinal axis L, a 2 mm thick washer 70 is fitted on both sides. Thus the adjustment cam 62 can be swivelled practically without play.

In longitudinal direction L, the peripheral surface 72 of the adjustment cam 62 is stepped on the end at both sides, creating a groove 74. The steps are shown in detail in FIGS. 6 and 7. When the control unit is mounted, a sliding block 90, shown in dotted lines and shown later in detail, rests on the peripheral surface 72.

On the right of FIG. 3 is drawn a rounded cover plate 76 which has rectangular opening slots (77 in FIG. 4) for the adjustment levers 78. Next to each opening slot is printed or applied a scale of 0–35 with which the self-locking adjustment levers 78 can be swivelled into a prespecified position.

Figure 4:
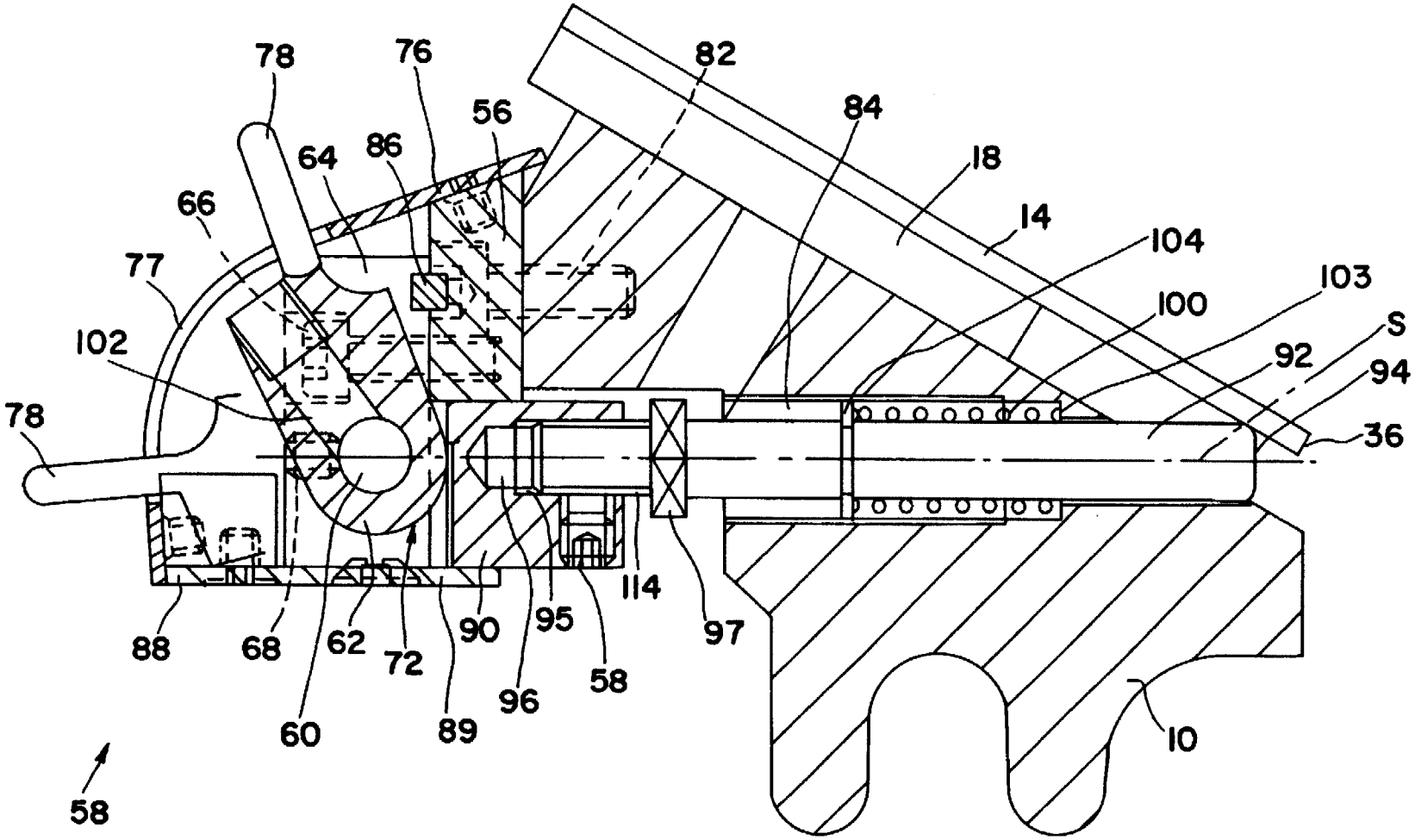
FIG. 4: a section through a control unit attached to an ink duct.

FIG. 4 shows the lower area of an ink duct 10 with the ink blade 14. A control unit 58 is attached to the ink duct 10 via mounting rail 86. It is attached via countersunk screws 82 arranged at regular intervals.

The bearing jaws 64 are each attached to the mounting rail 56 with one screw 66. In a corresponding groove on mounting rail 56 and bearing jaws 64 is inserted a rectangular profile 86 which prevents the bearing jaws 64 from twisting.

A base plate 88, projecting on one side, is screwed to bearing jaws 64 at regular intervals. The mounting rail 56, bearing jaws 64 and projecting base plate 88 form a groove, rectangular in cross-section, in which are fitted sliding blocks 90. These lie on the peripheral surfaces 72 of the adjustment cams 62.

The adjustment cam 62 is drawn in its upper position and indicated in its lower position. On adjustment of the adjustment cam 62, the sliding block is moved in the direction of longitudinal axis S of a tappet 92 anchored in the sliding block. This tappet 92 is mounted on bearings in a stepped hole 84 in ink duct 10 and lies with the slightly rounded end 94 on the ink blade 14 in the area of the blade edge 36. The sliding block 90 has a hole 96 with an internal thread 95 in which is turned an external thread 114 of the tappet 92. A hexagonal head 97 of tappet 92, easily accessible externally, allows easy turning and thus finely controlled and precise length adjustment of the tappet 92. The hexagonal head 96 can be replaced by similar means, for example radial holes in the outer shell into which a pin can be inserted.

The tappet 92 is fixed by a plastic screw 98 working directly on the outer thread of the tappet. The tappet 92 is adjusted only at larger time intervals, the everyday spacing adjustment is made with the adjustment cam 62.

The tappet is always pressed in the direction of sliding block 90 by means of a spring 100. Spring 100 is supported at one end on a step 103 in hole 84 and at the other on a circlip ring 104.

Figure 5:
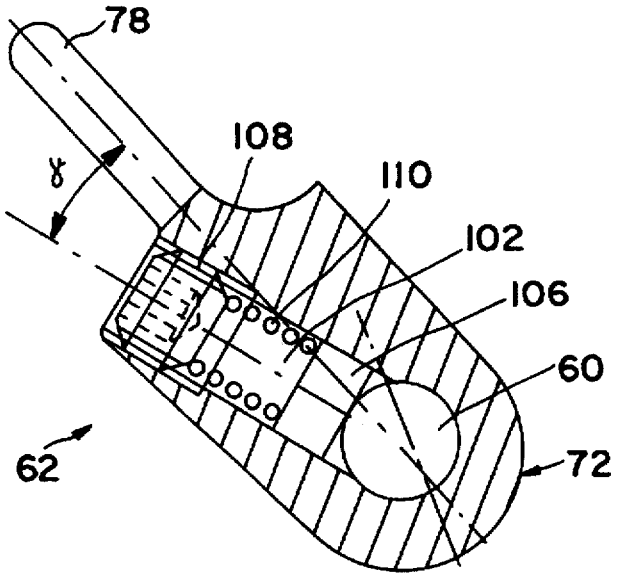
FIG. 5: a section through an adjustment cam.
Figure 6:
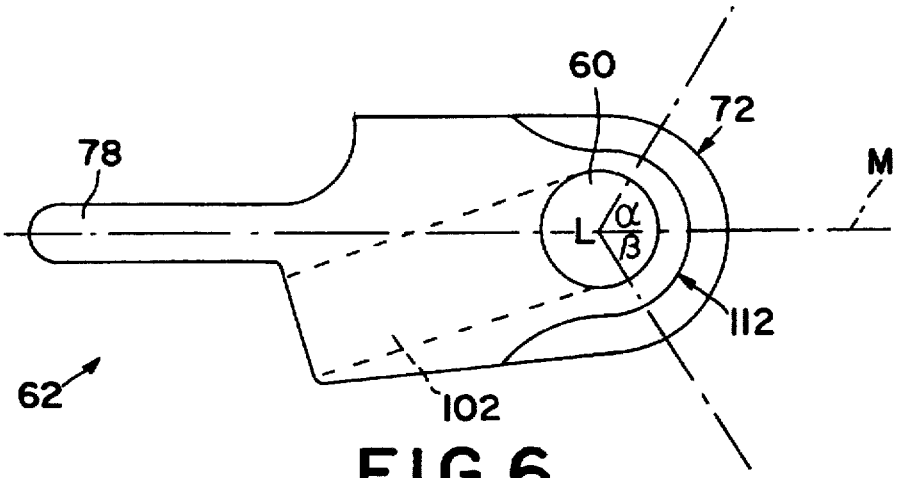
FIG. 6: a front view of an adjustment cam in its axial direction.
Figure 7:
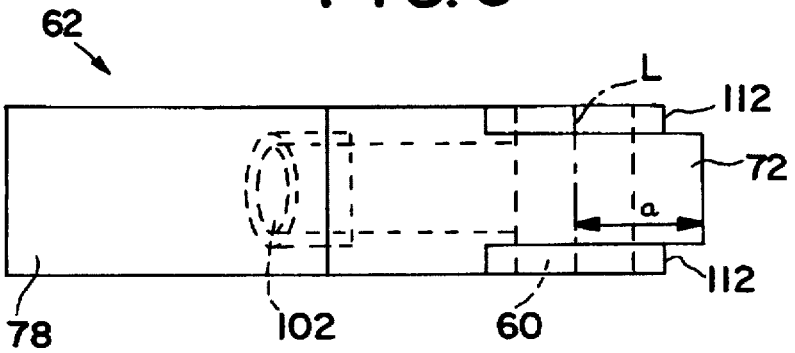
FIG. 7: a top view of an adjustment cam of FIG. 6, FIG. 8: a front view of a tappet.

The adjustment cam 62, shown in more detail in FIGS. 5 to 7, has a hole 102, angled in relation to the adjustment lever 78, to hold the means constituting a self-locking device (FIG. 5).

The hole 102, offset by an angle $\gamma$ of approx. 150 in relation to the flat adjustment lever 78 in FIG. 5, is aligned with the bearing bolt 60. Into this hole 102 is introduced a disc-like brake element 106 which, after turning a screw 108, is pressed on the fixed bearing bolt 60 by the force of a spring 110 and thus the said adjustable self-locking is achieved.

FIGS. 6, 7 show the curved peripheral surface 72 of adjustment cam 62, produced with very great precision. Distance a of the peripheral surface 72 from axis L is at its greatest on the longitudinal centre plane M of the adjustment lever 78, on which plane preferably lies longitudinal axis L of the bearing bolt 60. This distance a diminishes progressively, for example by a total of 0.3 mm, over an angle $\alpha$ or $\beta$. In other words, in the area of longitudinal centre plane M, distance a diminishes first slowly and then at an increasing rate.

FIGS. 6, 7 also show that the peripheral surface 72 of the adjustment cam 62 is stepped at beth ends. The two stepped surfaces 112 run in circles, they have nothing to do with the cam action but serve to create a guide groove for the sliding block 90 (FIGS. 3, 9, 10).

Figure 8:
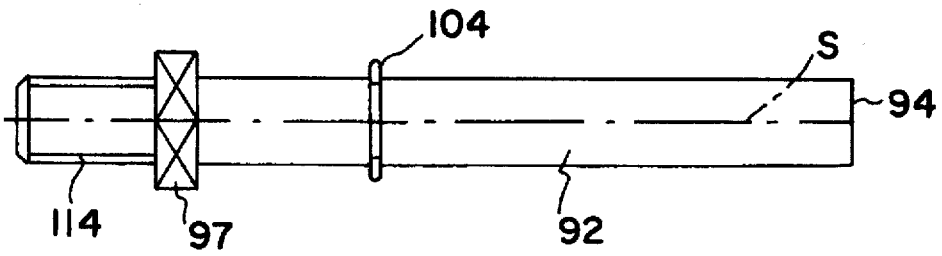

FIG. 8 shows a tappet 92 where the actuating spring (100 in FIG. 4) has been omitted. The front end 94 is rounded with a radius of for example 1–1.5 mm. This rounded end lies on the ink blade (14 in FIG. 4). The circlip ring 104 supporting the spring, not shown, is inserted in M circular groove. An external thread 114 for screwing into a sliding block 90 begins at hexagonal head 97.

Figure 9:
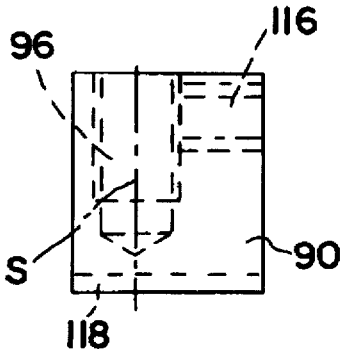
FIG. 9: a front view of a sliding block.
Figure 10:
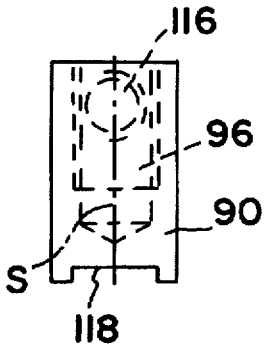
FIG. 10: a side view of a sliding block of FIG. 9, FIG. 11: a front view of a bearing jaw.

The sliding block 90 with hole 96 for the tappet 92 (FIG. 8) and a further hole 116 arranged perpendicular to this for the looking screw 98 (FIG. 4) is shown in FIGS. 9, 10. These figures also show a through groove 118 which serves to hold the peripheral surface 72 of the adjustment cam 62 (FIGS. 5–7). Thus the tappet mounted in sliding block 90 is also fixed in the direction of longitudinal axis L (FIG. 3). The sliding block 90 can only move in the direction of longitudinal axis S of tappet 92 (FIG. 8). In both other directions it is fixed practically without play.

Figure 11:
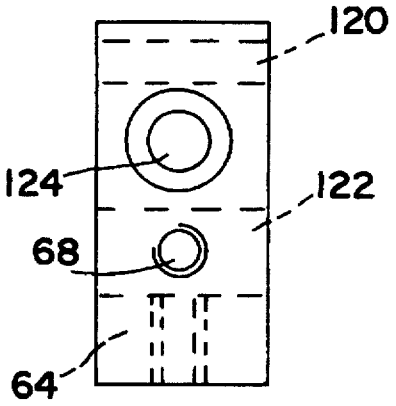
Figure 12:
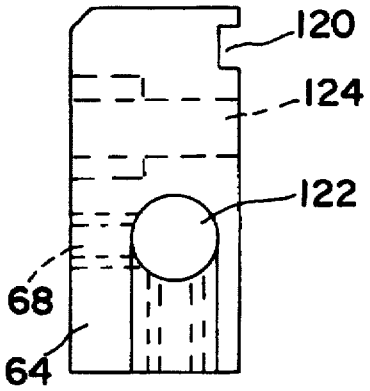
FIG. 12: a side view of a bearing jaw of FIG. 11.

The bearing jaw 64 shown in FIGS. 11, 12 also has a through groove 120 in which is inserted the rectangular profile 86 (FIG. 4). A through hole 122 serves to hold bearing bolts 60 (FIG. 4). These are held via a screw introduced into the threaded hole 68. Finally, the threaded hole 124 for screw 66 is drawn, which serves to screw the bearing jaw to the mounting rail 56 (FIGS. 3, 4).

I claim:

1. In an offset printing machine having an ink roller disposed along an axis (A) and having a cylindrical surface and at least one ink blade with an edge for applying ink from an ink bath to the ink roller; an adjustment means for bending the edge of the at least one ink blade to different degrees against the cylindrical surface of the roller; the adjustment means having a plurality of tappets axially displaceable in a guide; a plurality of adjustment cams each associated with each of the plurality of tappets, the plurality of cams being disposed along and rotatable about an axis (L) parallel to axis (A); spring means associated with the tappets for pressing the tappets against a peripheral surface of each adjustment cam, the improvement which comprises: the peripheral surface of each cam comprises a progressively curved surface having a midpoint wherein the curved surface is spaced a distance a from the rotational axis (L) wherein the distance a is greatest at the midpoint of the curved surface and diminishes on either side of the midpoint.

2. A machine according to claim 1 wherein the distance a diminishes progressively on either side of the midpoint through an angle ($\alpha$, $\beta$) of about 60° maximum with respect to a line drawn from the peripheral surface through axis (L).

3. A machine according to claim 1, further comprising a control unit with a longitudinal groove, wherein the adjustment cams are arranged alternately along axis (L) with bearing jaws on a mounting rail for interchangeably mounting on the offset printing machine wherein the peripheral surface of each of the adjustment cams lie freely in said longitudinal groove of said control unit.

4. A machine according to claim 1 wherein each of the tappets are mounted in a sliding block which is guided and pressed on the peripheral surface of the adjustment cams.

5. A machine according to claim 4 wherein the sliding blocks have a hole with an internal thread for receiving a corresponding external thread of the tappets.

6. A machine according to claim 5 wherein each tappet is fixed non-rotatably by means of a screw in a side hole of the sliding block.

7. A machine according to claim 6 wherein the tappets are adjustable length-wise and have means for rotating about their longitudinal axis.

8. A machine according to claim 1 further comprising a brake element means for causing self-locking of the cams.

9. A machine according to claim 3 wherein washers are located between the adjustment cams and bearing jaws.

10. A machine according to claim 4 wherein the adjustment cams have on both sides a stepped configuration on the peripheral surface defining a reduced width peripheral surface which fits into a groove on the corresponding sliding block.

11. A machine according to claim 1, wherein the progressively curved surface has a progressively diminishing radius of curvature.

12. In an offset printing machine having an ink roller disposed along an axis (A) and having a cylindrical surface and at least one ink blade with an edge for applying ink from an ink bath to the ink roller; an adjustment means for bending the edge of the at least one ink blade to different degrees against the cylindrical surface of the roller; the adjustment means having a plurality of tappets axially displaceable in a guide; a plurality of adjustment cams each associated with each of the plurality of tappets, the plurality of cams being disposed along and rotatable about an axis (L) parallel to axis (A); spring means associated with the tappets for pressing the tappets against a peripheral surface of each adjustment cam, the improvement which comprises: the peripheral surface of each cam comprises a progressively curved surface having a midpoint, wherein the curved surface is spaced a distance a from the rotational axis (L), wherein the distance a is greatest at the midpoint of the curved surface, and wherein the curved surface has a progressively diminishing radius of curvature on at least one side of the midpoint.

* * * * *